US009659427B2

(12) United States Patent
Stinson

(10) Patent No.: US 9,659,427 B2
(45) Date of Patent: May 23, 2017

(54) VENDING MACHINE AND ASSOCIATED METHODS

(71) Applicant: Shoprobotic Ltd., Newark, Nottinghamshire (GB)

(72) Inventor: Philip Stinson, Newark (GB)

(73) Assignee: ShopRobotic, Ltd., Newark, Nottinghamshire (GB)

( * ) Notice: Subject to any disclaimer, the term of this patent is extended or adjusted under 35 U.S.C. 154(b) by 0 days.

(21) Appl. No.: 14/334,486

(22) Filed: Jul. 17, 2014

(65) Prior Publication Data

US 2015/0021348 A1 Jan. 22, 2015

(30) Foreign Application Priority Data

Jul. 17, 2013 (GB) ..... 1312791.5

(51) Int. Cl.
*G07F 11/42* (2006.01)
*G07F 11/16* (2006.01)

(52) U.S. Cl.
CPC ..... *G07F 11/42* (2013.01); *G07F 11/165* (2013.01)

(58) Field of Classification Search
CPC ..... G07F 11/165; G07F 11/42
(Continued)

(56) References Cited

U.S. PATENT DOCUMENTS 3,800,932 A * 4/1974 Dana ..... G07F 11/52 194/240
4,351,518 A * 9/1982 Stievenart ..... B65H 3/0808 198/468.4

(Continued)

FOREIGN PATENT DOCUMENTS

DE 102010001570 A1 8/2011
EP 0634783 A1 6/1994

(Continued)

*Primary Examiner* — Michael K Collins
(74) *Attorney, Agent, or Firm* — Maynard Cooper & Gale, P.C.; Jon E. Holland

(57) ABSTRACT

A vending machine comprises a robotic arm and a pick mechanism that is coupled to the robotic arm. The pick mechanism is configured to retrieve a vendible product in the vending machine, and the robotic arm is configured to locate the pick mechanism at a location with a x-y coordinate that corresponds to the vendible product. The pick mechanism comprises a first roller, a second roller, and a belt that mechanically links the first and second rollers by forming a loop around the first and second rollers. The belt has a first portion and a second portion on opposing sides of the loop, and the second portion of the belt is coupled to the robotic arm. The pick mechanism further comprises a motor that is configured to rotate the first roller in order to translate the first and second portions of the belt in opposite directions to each other. The pick mechanism further comprises a picker arm extending in the z direction. The picker arm has a proximal portion closest to the first roller and a distal portion furthest from the first roller. The proximal portion is coupled to the first portion of the belt in order to be moved in the z-direction as the first roller is rotated, and the distal portion comprises a product picker for releasably attaching to the vendible product.

20 Claims, 5 Drawing Sheets

(58) Field of Classification Search
USPC ..... 221/13, 210, 211
See application file for complete search history.

(56) References Cited

U.S. PATENT DOCUMENTS

| | | | | |
|---|---|---|---|---|
| 5,267,483 | A * | 12/1993 | Torii | B25J 9/02 74/490.01 |
| 8,036,774 | B2 * | 10/2011 | Blust et al. | G06Q 10/08 700/232 |
| 8,041,454 | B2 * | 10/2011 | Blust et al. | G06Q 10/087 700/232 |
| 8,511,196 | B2 * | 8/2013 | Ubidia | B25J 9/102 475/196 |
| 8,561,994 | B1 | 10/2013 | Jeong et al. | |
| 8,631,969 | B2 | 1/2014 | Faes | |
| 8,972,041 | B2 * | 3/2015 | Hancock | G07F 11/165 700/213 |
| 2003/0234259 | A1 | 12/2003 | Selfridge | |
| 2004/0238557 | A1 * | 12/2004 | Chirnomas | A23G 9/28 221/124 |
| 2008/0017660 | A1 | 1/2008 | Faes | |
| 2008/0093371 | A1 * | 4/2008 | Ubidia | B25J 9/041 221/1 |
| 2009/0076650 | A1 * | 3/2009 | Faes | G07F 11/165 700/232 |
| 2010/0145507 | A1 * | 6/2010 | Blust et al. | G07F 11/165 700/232 |
| 2013/0123978 | A1 * | 5/2013 | Stark et al. | G07F 11/165 700/242 |
| 2014/0037404 | A1 * | 2/2014 | Hancock | G07F 11/165 414/273 |
| 2015/0021348 | A1 * | 1/2015 | Stinson | 221/1 |

FOREIGN PATENT DOCUMENTS

| | | | |
|---|---|---|---|
| EP | 2006812 | | 12/2008 |
| EP | 2138983 | | 12/2009 |
| EP | 2175431 | A1 | 4/2010 |
| JP | 325595 | A | 2/1991 |
| JP | 8167066 | A | 6/1996 |
| JP | 2012123585 | A | 6/2012 |
| JP | 2012123656 | A | 6/2012 |
| JP | 2012155513 | A | 8/2012 |
| WO | 03072471 | A1 | 9/2003 |
| WO | 2012080527 | A1 | 6/2012 |

* cited by examiner

VENDING MACHINE AND ASSOCIATED METHODS

CROSS REFERENCE TO RELATED APPLICATION

The present disclosure claims priority to GB Patent Application No. 1312791.5, filed on Jul. 17, 2013, which is incorporated herein by reference.

FIELD OF THE DISCLOSURE

The present disclosure generally relates to vending machines and associated methods.

RELATED ART

Various dispensing or vending machines rely on fixed pitch spiral or fixed pitch conveyor delivery systems. Individual product selections require an individual mechanism for each product, consisting of a powered spiral or a powered segmented conveyor. Such machines suffer from a number of disadvantages, such as low volumetric efficiency of product density due to the fixed pitch nature of the spiral, physical damage to the products caused by forces induced by the spiral, and physical damage to the product caused by dropping the product to a delivery compartment.

EP 2138983 A2 discloses an apparatus for moving an article that contains a first telescoping tube movably connected to a second telescoping tube, a suction cup connected to said first telescoping tube, and a drive assembly connected to the first telescoping tube.

SUMMARY OF THE DISCLOSURE

In accordance with a first aspect of the disclosure, there is provided a vending machine, which comprises a robotic arm and a pick mechanism that is coupled to the robotic arm. The pick mechanism is configured to retrieve a vendible product in the vending machine, and the robotic arm is configured to locate the pick mechanism at a location with a x-y coordinate that corresponds to the vendible product. The pick mechanism comprises a first roller, a second roller, and a belt that mechanically links the first and second rollers by forming a loop around the first and second rollers. The belt has a first portion and a second portion on opposing sides of the loop, and the second portion of the belt is coupled to the robotic arm. A motor is configured to rotate the first roller in order to translate the first and second portions of the belt in opposite directions to each other. The vending machine also comprises a picker arm extending in the z direction. The picker arm has a proximal portion closest to the first roller and a distal portion furthest from the first roller. The proximal portion is coupled to the first portion of the belt in order to be moved in the z-direction as the first roller is rotated, and the distal portion comprises a product picker for releasably attaching to the vendible product. The belt may be a toothed belt that is configured to engage with corresponding teeth on the first and second rollers. The motor may be a stepper motor.

The vending machine may further comprise a product picker sensor configured to sense when the product picker encounters a vendible product at an x-y location. The picker sensor is further configured to store in memory the location in the z direction of the product at the x-y location as a reference product location. The vending machine may optionally comprise a controller configured to control the motor in accordance with the reference product location for a subsequent vendible product retrieval from the x-y location.

The controller may be configured to control the speed of the motor when moving the picker arm in the z direction. The controller may also be configured to set the speed of the motor as a first value when the product picker is more than a threshold distance from the next product at the x-y location, and the controller may optionally be configured to set the speed of the motor as a second value, which may be different to the first value, when the product picker is less than a threshold distance from the next product at the x-y location. The first value may be greater than the second value.

The controller may be configured to set a product location offset as the thickness of the product at the x-y location and to determine the location in the z direction of the next product at the x-y location by adding or subtracting the product location offset to or from the reference product location.

The controller may be configured to determine a product location offset by multiplying the thickness of the product at the x-y location by the number of product retrievals from the x-y location since the reference product location was stored. The controller may also be configured to determine the location in the z direction of the next product at the x-y location by adding or subtracting the product location offset to or from the reference product location.

The product picker may be a vacuum picker.

The vending machine may further comprise a camera and a controller. The camera is configured to record image data representative of the contents of the delivery area. The controller is configured to process the recorded image data in order to identify whether or not a product is positioned in the delivery area and optionally to determine an identity of the product.

The controller may be configured to compare the recorded image data with one or more sets of image data stored in memory to identify a product that is present in the delivery area. The controller may be configured to store the recorded the image data in memory associated with a log of product delivery events. The controller may be configured to automatically transmit the image data to a third party in the event of an error message being returned to the controller. The controller may also be configured to automatically control operation of a user access door to a delivery area of the vending machine in accordance with the identification of whether or not a product is positioned in the delivery area and optionally in accordance with the determined identity of the product.

The vending machine may further comprise a delivery area for the vendible product, a user access door to the delivery area, a stepper motor, and optionally a back EMF stall detector. The stepper motor is configured to control the operation of the user access door. The back EMF stall detector is associated with the stepper motor and is configured to detect if the user access door has been obstructed. The back EMF stall detector is further configured to provide a signal to a controller such that the controller is configured to stop the stepper motor.

The vending machine may further comprise a video camera, a user interface, and a display screen. The video camera is configured to record image data representative of a customer that is interacting with the vending machine, and the user interface is configured to receive a customer selection of a vendible product. The display screen is configured to display a selected vendible product and the image data of the customer such that the selected vendible product is appropriately located relative to the customer.

The vending machine may further comprise: individually addressable lights associated with one or more storage locations in the vending machine; a user interface configured to receive a customer selection of a vendible product; and a controller configured to control the lighting levels of the individually addressable lights in accordance with the user interaction with the user interface.

The vending machine may further comprise a display screen and one or more video cameras associated with the pick mechanism. The video camera is configured to record, and display in real-time on the display screen, a vendible product as it is being retrieved form a storage location and delivered to a delivery area.

There may be provided a controller for a vending machine. The vending machine comprises a pick mechanism that is configured to retrieve a vendible product in the vending machine. The pick mechanism comprises a product picker for releasably attaching to the vendible product and a motor configured to translate the product picker in a z direction towards the vendible product. The vending machine further comprises a product picker sensor configured to sense when the product picker encounters a vendible product. The controller is configured to receive a sensor signal from the product picker sensor and store in memory the location in the z direction of the vendible product as a reference product location. The controller is further configured to control the speed of the motor in accordance with the reference product location for a subsequent vendible product retrieval.

The controller may be configured to set the speed of the motor as a first value when the product picker is more than a threshold distance from a vendible product for the subsequent vendible product retrieval. The controller may be optionally configured to set the speed of the motor as a second value, which may be different to the first value, when the product picker is less than a threshold distance from a vendible product for the subsequent vendible product retrieval. The first value may be greater than the second value.

The controller may be configured to set a product location offset as the thickness of the vendible product. The controller may also be configured to determine the location in the z direction of the next vendible product by adding or subtracting the product location offset to or from the reference product location.

The controller may be configured to determine a product location offset by multiplying the thickness of the vendible product by the number of product retrievals since the reference product location was stored. The controller may also be configured to determine the location in the z direction of the next vendible product by adding or subtracting the product location offset to or from the reference product location.

There may be provided a vending machine that comprises a pick mechanism, a product picker sensor, and any controller disclosed here. The pick mechanism is configured to retrieve a vendible product in the vending machine, and the pick mechanism comprises a product picker for releasably attaching to the vendible product. The pick mechanism further comprises a motor configured to translate the product picker in a z direction towards the vendible product. The product picker sensor is configured to sense when the product picker encounters a vendible product.

There may be provided a method of controlling a vending machine, which comprises a pick mechanism and a product picker sensor. The pick mechanism is configured to retrieve a vendible product in the vending machine. The pick mechanism comprises a product picker for releasably attaching to the vendible product, and the pick mechanism further comprises a motor configured to translate the product picker in a z direction towards the vendible product. The product picker sensor is configured to sense when the product picker encounters a vendible product, and the method comprises receiving a sensor signal from the product picker sensor and storing in memory the location in the z direction of a product as a reference product location. The method further comprises controlling the speed of the motor in accordance with the reference product location for a subsequent vendible product retrieval.

There may be provided a computer program, which when run on a computer, causes the computer to configure any apparatus, including a vending machine or controller disclosed herein or perform any method disclosed herein. The computer program may be a software implementation, and the computer may be considered as any appropriate hardware, including a digital signal processor, a microcontroller, and an implementation in read only memory (ROM), erasable programmable read only memory (EPROM) or electronically erasable programmable read only memory (EEPROM), as non-limiting examples.

The computer program may be provided on a computer readable medium, which may be a physical computer readable medium such as a disc or a memory device, or may be embodied as a transient signal. Such a transient signal may be a network download, including an internet download.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Figure 1:
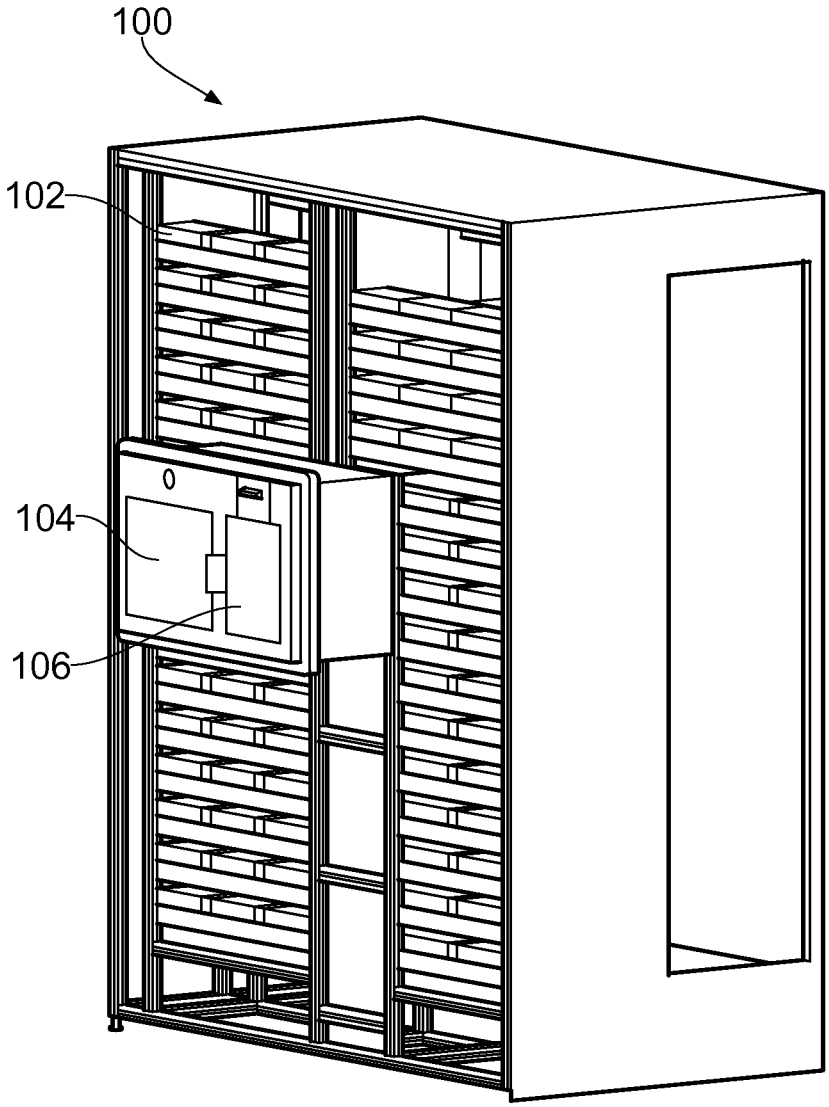
FIG. 1 illustrates a front view of a vending machine.

FIG. 1 shows a front view of a vending machine 100. The vending machine 100 comprises a plurality of storage locations 102, in which vendible products can be stored. The plurality of storage locations 102 may be organised in a regular array, as is known in the art. Different vendible products may be stored at different storage locations within the vending machine 100. Typically vendible products of the same type are aligned in a row in a storage location that extends through the thickness of the vending machine (what will be referred to as the z direction below).

The vending machine 100 comprises a display screen 104 for providing a user interface, by which a user may interact with the vending machine 100 to select a vendible product or products for purchase. Once selected, vendible products can then be conveyed from an appropriate storage location 102 to a delivery area 106 for access by the user.

Figure 2:
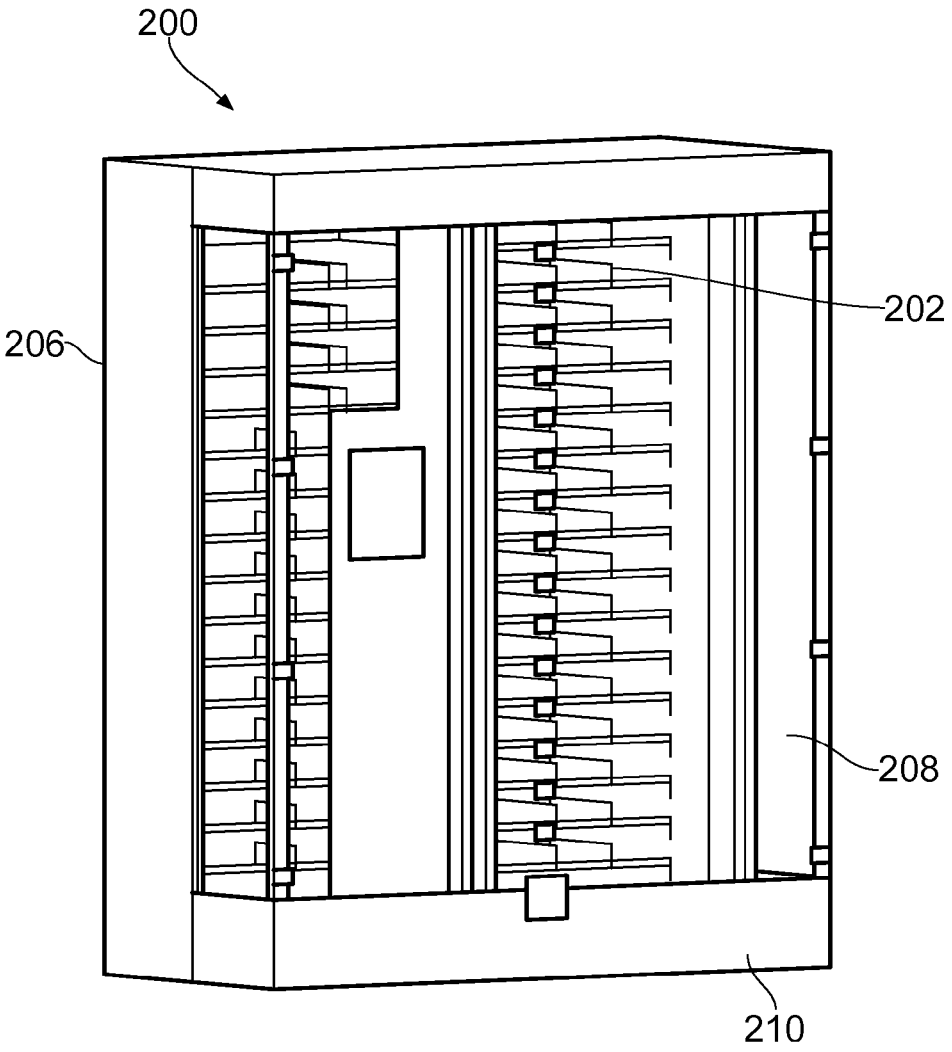
FIG. 2 illustrates a rear view of a vending machine.

FIG. 2 shows a rear view of the vending machine 200 of FIG. 1. The plurality of storage locations 202 can be seen from the rear. The vending machine 200 has a delivery area opening 206 through which a vendible product or products may be moved to position them in the delivery area. FIG. 2 also shows a void 208 between the rear of the storage locations 202 and the rear face 210 of the vending machine 200. The void 208 provides a space within which a robotic arm can move in order to transport a vendible product from a storage location 202 to the delivery area through the delivery area opening 206.

Figure 3:
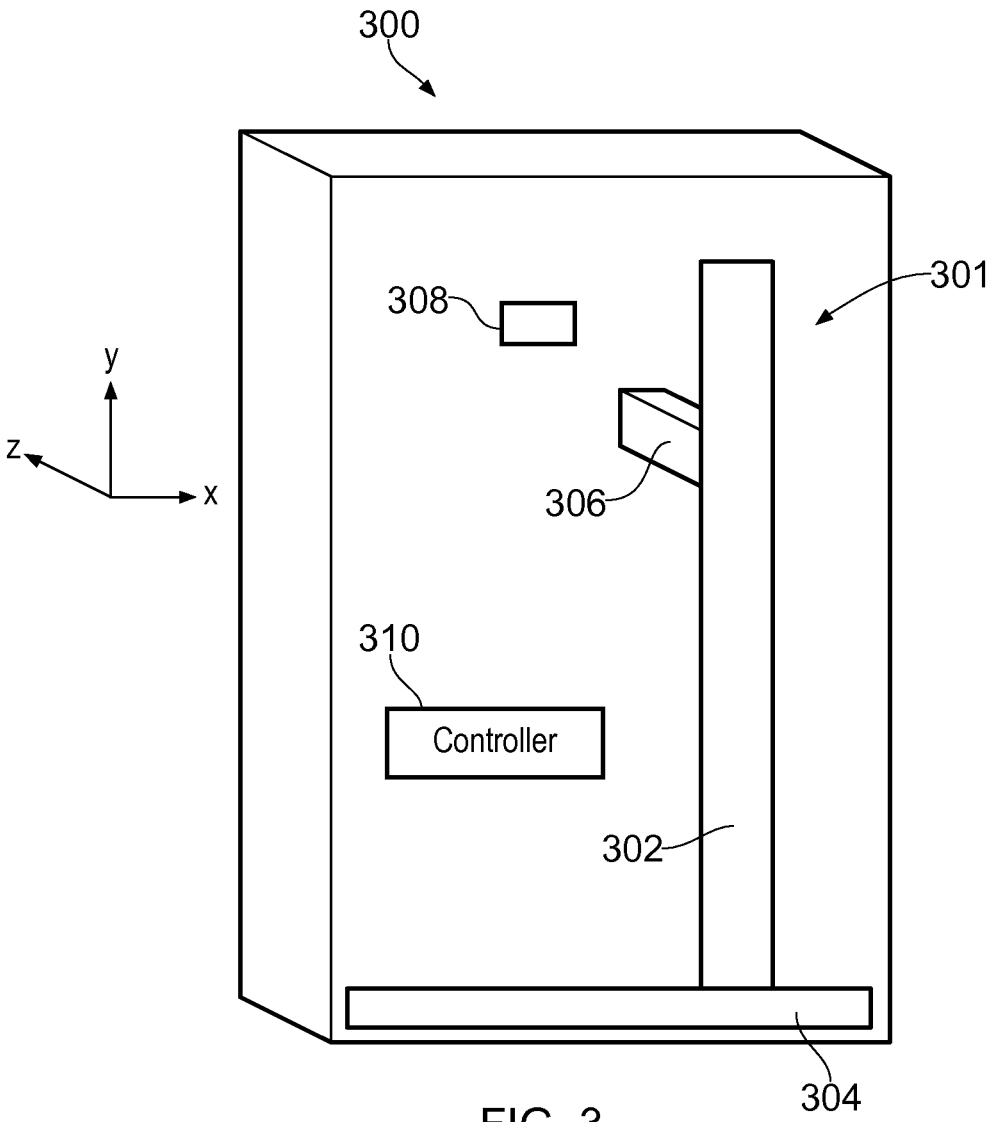
FIG. 3 illustrates a rear view of a vending machine with a robotic arm configured to move a picker arm in two dimensions.

FIG. 3 shows a rear view of a vending machine 300 with a robotic arm 301. Coupled to the robotic arm 301 is a pick mechanism 306 that is used to retrieve a vendible product from a storage location. The robotic arm 301 is used to locate the pick mechanism 306 at a location with a x-y coordinate that corresponds to the vendible product that is to be retrieved. One of the x or y coordinates may be a fixed value if there is only a single row or column of vendible products.

The robotic arm 301 in this example comprises a first portion 302 which is configured to allow movement of the pick mechanism 306 in a first direction. The first direction corresponds to the y-direction of the rectangular coordinate system illustrated in FIG. 3. In this example, the first portion has a track (not shown), which extends in the y-direction, along which the pick mechanism 306 can be moved by a suitable motor.

The robotic arm 301 also comprises a second portion 304 which is configured to allow movement of the pick mechanism 306 in a second direction. The second direction is perpendicular to the first direction and corresponds to the x-direction of the illustrated coordinate system. In this example, the second portion 304 has a track (not shown), which extends in the x-direction, along which the first portion 302, and hence the pick mechanism, can be moved by a suitable motor.

A controller 310 is provided to control the motors associated with the first portion 302 and the second portion 304 of the robotic arm 301 such that the pick mechanism 306 is positioned at a desired location within the x-y coordinate plane within the vending machine 300. In particular, the pick mechanism 306 can be positioned at an x-y coordinate that is adjacent to a storage location 308 that has a vendible product that has been requested by a user using the user interface mentioned above with reference to FIG. 1. The pick mechanism can then be extended in the z direction in order to retrieve the vendible product, as described below.

The controller 310 will be referred to throughout this disclosure as controlling various aspects of the operation of the vending machine.

Although a Cartesian coordinate system in terms of x, y and z coordinates is described herein, it will be appreciated that any other coordinate system can be used to identify the location of the pick mechanism 306.

Figure 4:
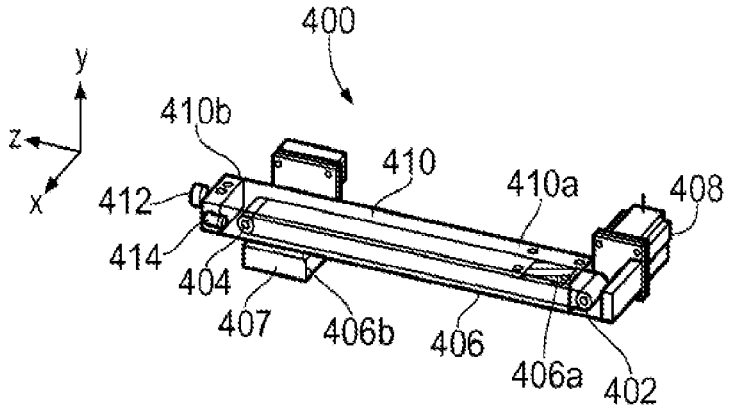
FIG. 4 illustrates a pick mechanism arm in a fully retracted position.
Figure 5:
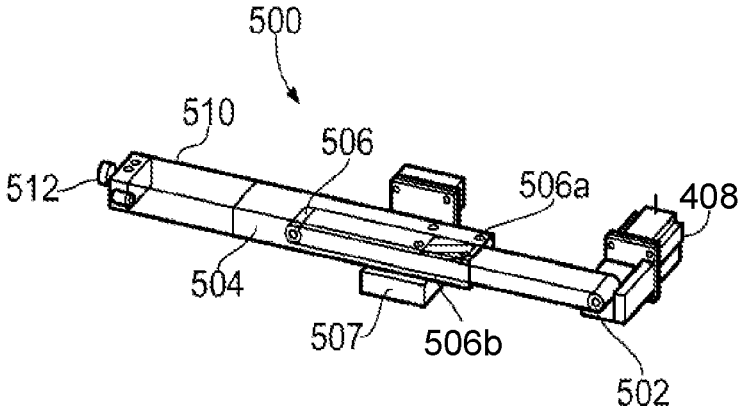
FIG. 5 illustrates a pick mechanism in a half extended position.
Figure 6:
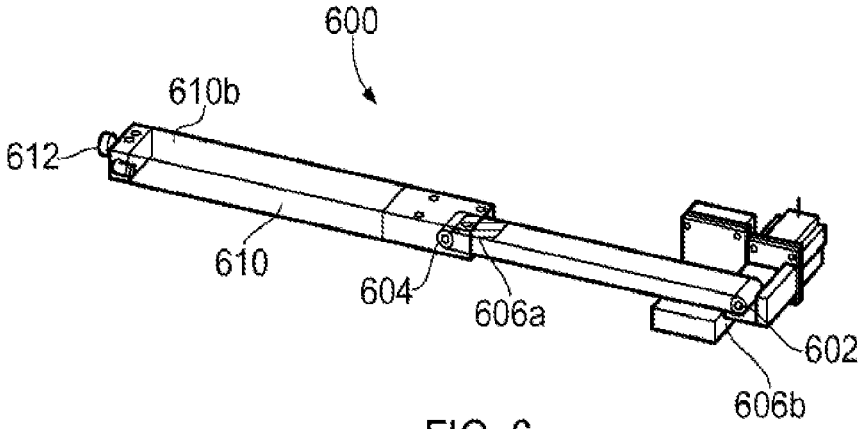
FIG. 6 illustrates a pick mechanism in a fully extended position.

FIGS. 4 to 6 show a pick mechanism that is fully retracted, half extended and fully extended, respectively. The pick mechanism can be extended to releasably attach to a vendible product, and then can be retracted and moved to another location for detaching from the vendible product in order to deliver the vendible product to a user/customer. The mechanism described with reference to FIGS. 4 to 6 may be referred to as linear motion system that uses an opposite drive belt mechanism.

FIG. 4 shows a pick mechanism 400 in the fully retracted position. The pick mechanism 400 comprises a first roller 402, a second roller 404 and a belt 406 mechanically linking the first roller 402 and the second roller 404. This linkage is such that the belt 406 forms a continuous loop around the first and second rollers 402, 404. The belt 406 has a first belt portion **406*a* and a second belt portion 406*b* that are on opposing sides of the loop. The second belt portion is coupled to the robotic arm of FIG. 3 via a fixed plate 407. The fixed plate 407** is referred to as "fixed" as it is in a fixed position in the z-dimension.

The pick mechanism 400 comprises a motor 408 configured to rotate the first roller 402. Rotation of the first roller 402 causes the belt 406 to move such that the first and second belt portions **406*a*, 406*b* are translated in opposite directions to each other. As shown in FIG. 4, the first belt portion 406*a* on the top of the belt 406 is nearest the first roller 402 when the pick mechanism is in the fully retracted position, and the second belt portion 406*b* on the bottom of the belt 406 is nearest the second roller 404. As will be described with reference to FIGS. 5 and 6, the relative locations of the first and second belt portions 406*a*, 406*b* are changed when the first roller 402** is rotated.

The pick mechanism 400 also comprises a picker arm 410. The picker arm extends in a direction that is transverse/perpendicular to the x-y plane in which the robotic arm of FIG. 3 is configured to move. This direction is labelled the z-direction in the coordinate system illustrated in FIG. 4. The picker arm 410 has a proximal portion **410*a* closest to the first roller 402 and a distal portion 410*b* furthest from the first roller 402. The proximal portion 410*a* is coupled to the first belt portion 406*a*, in this example by a plate that is identified in FIG. 4 as a moving plate. This plate is referred to as "moving" as it is movable in the z dimension in use. By means of this coupling, when the first belt portion 406*a* moves in the z-direction due to rotation of the first roller 402 by the motor 408, the picker arm 410** also moves in the z-direction.

The distal portion **410*b* of the picker arm 410 has a product picker 412 for releasably attaching to a vendible product. The product picker 412 may also be referred to as a picker head. In this example, the product picker 412 is a vacuum picker that has a suction cup. The vacuum picker also has a vacuum port 414 that is coupled to a vacuum pump for reducing the air pressure in the suction cup. A partial vacuum can be used to releasably attach the vendible product to the vacuum picker 412** when the suction cup is in contact with the vendible product. In this way, the vendible product can be retrieved and moved to a location for delivery to the user. At this location the partial vacuum can be removed and the vendible product detached from the vacuum picker.

FIG. 5 shows the pick mechanism 500 of FIG. 4 in a half extended configuration, in which the first roller 502 has been rotated sufficiently to translate the first belt portion **506*a* part of the distance between the first and second rollers 502, 504. The product picker 512 at the distal end of the picker arm 506 has been moved away from the fixed plate 507 in the z-direction by a distance that is equal to twice the distance that the first belt portion 506*a* has moved from the first roller 502. This is because, due to the coupling between the second belt portion 506*b* and the fixed plate 507, the belt drive system (the first roller, 502, the second roller 504 and the belt 506) has also been moved relative to the fixed plate 507** by the same amount that the first belt portion 506*a* has moved away from the first roller 502.

FIG. 6 shows the pick mechanism 600 of FIGS. 4 and 5 in a fully extended configuration, in which the first roller 602 has been rotated sufficiently to translate the first belt portion 606*a* substantially the whole of the distance between the first and second rollers 602, 604. Consequently, the picker arm 610 has been moved in the z-direction by a distance equal to about twice the distance between the first roller 602 and second roller 604.

In use, the pick mechanism is initially in a fully retracted configuration (as shown in FIG. 4) and is moved to an x-y coordinate that corresponds to the position of a storage location that includes the vendible product that is to be delivered. That is, the distal end 610*b* of the picker arm 610 is positioned in the same x-y coordinate as the vendible product, but is spaced apart from the vendible product in the z-direction.

The motor then rotates the first roller in a first direction until the product picker at the distal end of the picker arm is brought into close enough proximity to the vendible product in order for the vendible product to be releasably attached to product picker.

In some examples, a product picker sensor may be provided that senses when the product picker encounters the vendible product. For the example where the product picker is a vacuum picker with a suction cup, a vacuum sensor may be used that identifies when a partial vacuum is provided at the product picker due to the vendible product sealing the open part of the suction cup. The product picker sensor can provide a signal to the controller such that the controller can send a control signal to the picker mechanism in order stop further extension of the picker arm in the z-direction, which could damage the vendible product.

Once the vendible product is attached to the product picker, the motor can rotate the first roller in a second direction, which is opposite to the first direction, to retract the picker arm with the vendible product attached, so as to remove the vendible product from its storage location. The robotic arm of FIG. 3 is then moved to bring the pick mechanism into an x-y location that is adjacent to the delivery area opening of the vending machine, which is shown in FIG. 2. The motor of the pick mechanism may then be operated again if necessary in order to extend the picker arm and move the vendible product into the delivery area, where the vendible product can be released by the product picker. In this way, the vendible product is transferred from its storage location to the delivery area without being subject to any of the forces that may cause physical damage to the vendible product such as may occur in other types of vending machine.

It will be appreciated that the pick mechanism described with reference to FIGS. 4 to 6 is advantageously compact because the maximum extension of the product picker in the z-direction (as shown in FIG. 6) is twice the space required in the z-direction to accommodate the pick mechanism in the full retracted configuration (as shown in FIG. 4). Also, it has been found that the pick mechanism is mechanically reliable and can allow accurate control of the location of the product picker.

In some examples, the belt may be toothed such that it can engage with corresponding teeth or notches on the first and second rollers. In some examples the motor of the picker mechanism may be a stepper motor. Such a stepper motor can be particularly advantageous when used with a toothed belt and toothed rollers. Also, use of a stepper motor can beneficially avoid the need for any complicated encoders to monitor the location of the product picker, which may be required for other types of motor.

These examples can be advantageous as they can allow movement of the first and second portions of the belt, and hence the location of the product picker, to be accurately controlled. Such accurate control can reduce the likelihood that the product picker damages the vendible product by approaching the vendible product too quickly or by moving too far in the z-direction. Similarly, the likelihood that the product picker fails to attach to the vendible product because the product picker has not been moved far enough in the z-direction can be reduced.

In some examples, one or more guide rails may be provided to ensure that the picker arm moves in the correct direction. The guide rails may be in a fixed position relative to the first roller and second roller. The fixed plate and/or moving plate may be provided with apertures through which the guide rails extend. Optionally, the apertures may be fitted with bearings to reduce the friction that is experienced as the plates move along the guide rails. Two guide rails may be provided, one either side of the belt.

Optionally, one or both of the fixed plate and moving plate may also be provided with a belt aperture through which the belt passes in order to affix/clamp the plates to the associated portions of the belt. Such an example may be particularly convenient where the belt is a toothed belt.

In some examples, a vending machine can be provided that includes only some of the features described above with reference to FIGS. 1 to 6. That is some of the features described with reference to these figures can be optional. Such a vending machine may comprise a pick mechanism that can retrieve a vendible product in the vending machine, the pick mechanism comprising a product picker for releasably attaching to the vendible product and a motor configured to translate the product picker in a z direction towards the vendible product. Any type of mechanism for translating the product picker can be used. The vending machine also includes a product picker sensor, such as the vacuum sensor described above, that can sense when the product picker encounters a vendible product. The product picker sensor can store in memory the location in the z direction of the product as a reference product location. The vending machine also includes a controller that can control the motor, optionally the speed of the motor, in accordance with the reference product location for a subsequent vendible product retrieval.

The product picker sensor can store in memory the location in the z direction of the product as the reference product location following a restock of the vending machine. For example, a flag in memory may be set manually by a person who restocks the vending machine or can be set automatically by the controller if the controller identifies an operation of the vending machine that is associated with a restock; for example a sensor returning a signal indicative of a stock access door being opened. Then for a first vendible product retrieval for each x-y location after the flag in memory has been set, a reference product location may be recorded.

For each subsequent vendible product retrieval from the x-y location for which a reference product location has been recorded, the controller can determine a product location offset for that x-y location by multiplying the thickness of the product at the x-y location by the number of product retrievals from the x-y location since the reference product location was stored. Properties of the vendible products at specific x-y locations, including the thickness of the product, may be stored in memory that is accessible by the controller, for example in a planogram. The controller can then determine the location in the z direction of the next product at the x-y location by adding or subtracting the product location offset to or from the reference product location.

In some examples, the reference product location can be updated for each vendible product retrieval operation. In these examples, the product location offset can be set as the thickness of the product at the x-y location.

In a particularly advantageous example, the controller can set the speed of the motor as a first value when the product picker is more than a threshold distance from the next product at the x-y location, and set the speed of the motor as a second value, that is different to the first value, when the product picker is less than a threshold distance from the next product at the x-y location. In examples where the first value is greater than the second value, this can advantageously allow the product picker to be quickly moved from a fully retracted position to a location that is close to the vendible product without risk of encountering and potentially damaging the vendible product. Then, when the product picker is expected to be relatively close to the vendible product, the movement of the product picker can be slowed down to provide an adequate response time for the product picker to recognise the proximity of the vendible product and stop movement of the product picker in the x-direction such that the likelihood of damaging the vendible product picker by over-extending the picker mechanism is reduced. In this way, the control software for the product picker can use multiple speed settings to improve speed of performance. The system can store what was last picked from a location and then use the information to directly improve the performance of the machine.

The delivery area, as shown in FIG. 1, can be a relatively large area such that conventional sensors are not able to adequately detect the presence and/or identity of products in the delivery area. Such conventional sensors may comprise one or more light beams and reflectors configured to sense objects placed in the path of the light beam. Such sensors may not be able to differentiate between products of different types or other foreign objects placed in the delivery area. One or more examples disclosed herein include a camera that can record image data representative of the contents of the delivery area. As will be described below, the image data can be used to identify whether or not a product is positioned in the delivery area and optionally it can also be used to confirm the identity of the product.

The controller of the vending machine can control the camera such that it records image data in response to one or more predetermined vending machine operations or events. For example, the camera may record image data in response to a product being delivered to the delivery area, a user opening an access door to the delivery area to retrieve the product, and a user closing the access door to the delivery area following product retrieval. Each of these events can be identified or determined by the controller using conventional sensors. Alternatively or additionally, the camera can periodically record image data.

The recorded image data can be compared with one or more sets of image data stored in memory to identify a product that is present in the delivery area. In one example, the recorded image data may initially be compared with image data representative of the product that is expected to be in the delivery area, as defined by the product that the user selected via the user interface. The comparison may return a percentage match value. If the percentage match value is greater than a match threshold, for example 80%. 90% or 95%, then the controller can determine that the product that has been delivered to the user is correct and store this information in memory. For example, a log can be maintained that details product delivery events. If the controller determines that the match threshold is not exceeded for the image data representative of the expected product, then a comparison can be performed with other image data. For example, image data representative of other products that are located in the vending machine and/or image data representative of an empty delivery area can be used. The comparison with the highest percentage match value for the other image data can then be stored in memory, for example in the log mentioned above.

In some examples the camera may be a video camera that records video data for a predetermined period of time, or records video data between vending machine operations or events. For example, the video data recordal may start when a user opens the access door to the delivery door and may end when the user closes the access door.

Optionally the image data itself can also be stored in memory, possibly associated with the log of product delivery events mentioned above. Also, the controller may be configured to automatically transmit the image data to a third party, such as a vending machine maintenance company, in the event of any error message being returned to the controller.

Any of the data mentioned above associated with the image data and/or comparison of image data can advantageously be used by the controller in order to maintain an accurate inventory of products in the vending machine and also an accurate representation of products that have been delivered to a user. For example, re-stocking inventories and events can be automatically determined. Additionally, error messages can be raised that are associated with specific vendible products and/or storage locations. Such error messages can be automatically used by the controller to prevent product retrieval from a storage location that is identified as being faulty or being loaded with an incorrect product. For example, the controller may automatically remove the products in the faulty/erroneous location from a list of products that is offered to a customer by the user interface. The controller may automatically identify that a vendible product has been misaligned or reversed in its storage location. The controller may enable verification of a planogram of vendible products stored within the vending machine. Further details of planograms are provided below. Also, the controller may try and correct any faults that have been identified by running an appropriate fault correction algorithm.

Also, a user may have an account associated with vending machine that can be accurately maintained. The account may be an ad-hoc account that only relates to a single product delivery operation. Such accurate account maintenance may ensure that, for examples where a user must pay for retrieving a product, the user is only charged for products that have successfully been delivered. In one example, the vending machine will pre-authorise the credit card of the customer to ascertain that credit is available for the requested vendible product or products. The vending machine will then deliver the vendible product or products in any way as described herein, yet only charge the customer's card for vendible products that have been identified by the controller as being successfully located in the delivery area. Optionally, a full receipt can be printed to the customer based on the products that have been placed in the delivery area.

In some examples, the image data can be processed to automatically control operation of a user access door to the delivery area. For example, the user access door may automatically opened by the controller when it is determined that the correct product is located in the delivery area. Then, when the controller determines that the product is no longer in the delivery area, and optionally also that the delivery area is empty (by comparing the image data with image data representative of an empty delivery area), the user access door may be automatically closed.

A stepper motor can be used to control the operation of the user access door. As a safety measure, a back EMF stall detector can be associated with the stepper motor in order to detect if user access door, or any other component of the vending machine, has been obstructed. The back EMF stall detector can provide a signal to the controller such that the controller stops and optionally reverses the associated stepper motor.

As a further safety system, one or more doors of the vending machine can be electro solenoid operated. The controller can ensure that no vending machine movement can occur when any of the doors are in a predetermined configuration, for example if they are open when they should not be for a specific stage of a product delivery process. Also, the vending machine can support the identification of a user through different devices such as an RFID tag, pin code, Dallas chip. This can ensure that only authorised personnel are allowed to perform different maintenance tasks on the vending machine.

In some examples, the vending machine may have a camera, optionally a video camera that is configured to record image data representative of a customer that is interacting with the vending machine. Using a user interface associated with the vending machine, the customer can select a vendible product that is offered for sale by the vending machine. In this example, the vendible product is a wearable product such as an item of clothing, jewelry or a wearable accessory. The selected wearable product can then be displayed on a display screen of the vending machine along with the image data of the customer in order to show how the specific wearable product will look on the customer. This may involve using image processing techniques to identify an appropriate body part of the customer, and then appropriately locating the selected vendible product relative to that body part.

In examples where the camera is a video camera, the display screen may display real-time video images that show a front view of the customer with a virtual image of the selected product on the customer's person, with the location of the virtual image automatically tracking any movement of the customer. The customer can then directly purchase the goods from the vending machine and receive them instantly.

One or more of then vending machines disclosed herein may have individually addressable lights such as light emitting diodes (LEDs), including lights associated with one or more of the storage locations in the vending machine. In such examples, the controller can perform integrated lights management in order to provide complex lighting cues. These cues can be linked to the user interaction with the user interface of the vending machine. The controller can directly control the lighting levels of various lights. For example, when a customer requests a particular product, a unique lighting script can be run in order to produce the effect of selecting the product on a display area. The system can also allow for the vending machine to be illuminated differently based on time of day, and the day of the month/year. During a delivery sequence of the vendible product, the lighting may be controlled in order to highlight the different parts of the delivery sequence and guide the user through the operation of the vending machine. Such operation can improve the user's experience when interacting with the vending machine and can improve the operability of the vending machine.

In addition to, or instead of, the integrated lights management discussed above, one or more video cameras can be associated with the pick mechanism. Such video cameras can record, and display in real-time on the display screen, the product being retrieved form a storage location and delivered to a delivery area. As above, such operation can improve the user's experience of interacting with the vending machine. The controller may be configured to store the video data as associated with a particular transaction, and optionally also automatically transmit the video data to a third party, such as a vending machine maintenance company, in the event of any error message being returned to the controller. Such data transmission can enable the vending machine to be fixed more efficiently and effectively; in some examples remotely.

A controller of any vending machine disclosed herein can be configured for remote real-time configuration of a plan that is stored in memory associated with the vending machine, wherein the plan identifies the location of specific products/stock in the vending machine. Such a plan may be referred to as a planogram. Also, a change to the planogram may be scheduled for a specific point in time, for example to coincide with an expected restock of the vending machine.

Figure 7:
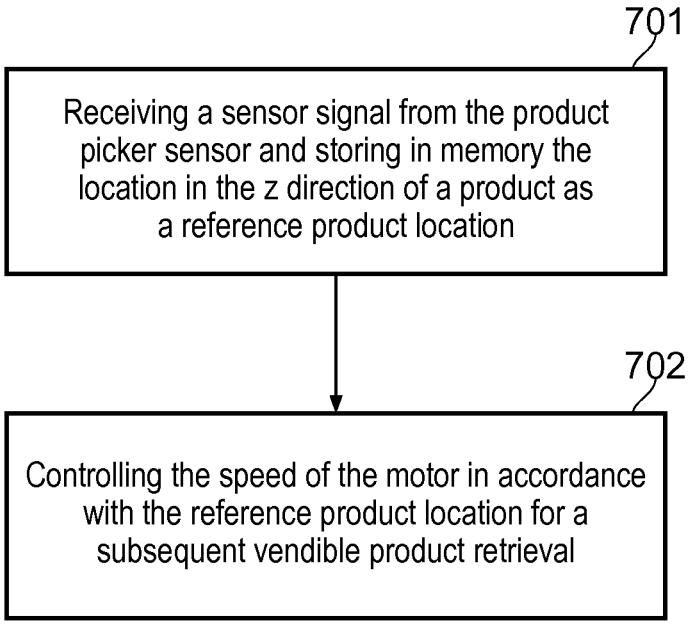
FIG. 7 illustrates a method of controlling a vending machine.

FIG. 7 illustrates a method of controlling a vending machine. The vending machine may have a pick mechanism configured to retrieve a vendible product in the vending machine. The pick mechanism may comprise a product picker for releasably attaching to the vendible product and a motor configured to translate the product picker in a z direction towards the vendible product. The vending machine may also have a product picker sensor configured to sense when the product picker encounters a vendible product.

The method begins at step 701 by receiving a sensor signal from the product picker sensor and storing in memory the location in the z direction of a product as a reference product location. Suitable apparatus for performing this method step is described above. The method continues at step 702 by controlling the speed of the motor in accordance with the reference product location for a subsequent vendible product retrieval. In this way, the subsequent product retrieval can be performed efficiently and quickly with a low likelihood that the product picker damages the vendible product de to over extension of the product picker.

It will be appreciated that the various features disclosed herein can be provided with any of the vending machines described, where the context permits. For example, the skilled person will recognise that some features of the vending machine that are described in this document are independent of other vending machine features, and therefore that such independent features can be considered optional.

Now, therefore, the following is claimed:

1. A vending machine comprising:

a robotic arm; and a pick mechanism coupled to the robotic arm, the pick mechanism configured to retrieve a vendible product in the vending machine, wherein the pick mechanism comprises a fully retracted configuration and a fully extended configuration;

wherein the robotic arm is configured to locate the pick mechanism at a location with a x-y coordinate that corresponds to the vendible product;

the pick mechanism comprising:

an opposite drive belt mechanism, comprising a first roller, a second roller, and a belt that mechanically links the first and second rollers by forming a loop around the first and second rollers, the belt having a first portion and a second portion on opposing sides of the loop, wherein the second portion of the belt is coupled to the robotic arm via a fixed plate that is fixed in a z direction;

a motor configured to rotate the first roller in order to translate the first and second portions of the belt in opposite directions to each other; and a picker arm extending in the z direction, the picker arm having a proximal portion closest to the first roller and a distal portion furthest from the first roller, wherein the proximal portion is coupled to the first portion of the belt in order to be moved in the z-direction as the first roller is rotated; and the distal portion comprises a product picker for releasably attaching to the vendible product, wherein, in the fully extended configuration, an extension of the distal portion of the picker arm, away from the fixed plate, in the z direction is equal to substantially twice a distance that the first belt portion has moved from the first roller.

2. The vending machine of claim 1, wherein the belt is a toothed belt that is configured to engage with corresponding teeth on the first and second rollers and the motor is a stepper motor.

3. The vending machine of claim 1, further comprising:

a product picker sensor configured to sense when the product picker encounters a vendible product at an x-y location, and to store in a memory device the location in the z direction of the product at the x-y location as a reference product location; and a controller configured to control the motor in accordance with the reference product location for a subsequent vendible product retrieval from the x-y location;

wherein the controller is configured to control the speed of the motor when moving the picker arm in the z direction.

4. The vending machine of claim 3, wherein the controller is configured to:

set the speed of the motor as a first value when the product picker is more than a threshold distance from the next product at the x-y location, and set the speed of the motor as a second value, that is different to the first value, when the product picker is less than a threshold distance from the next product at the x-y location;

wherein the first value is greater than the second value.

5. The vending machine of claim 3, wherein the controller is configured to:

set a product location offset as the thickness of the product at the x-y location; and determine the location in the z direction of the next product at the x-y location by adding or subtracting the product location offset to or from the reference product location.

6. The vending machine of claim 3, wherein the controller is configured to:

determine a product location offset by multiplying the thickness of the product at the x-y location by the number of product retrievals from the x-y location since the reference product location was stored; and determine the location in the z direction of the next product at the x-y location by adding or subtracting the product location offset to or from the reference product location.

7. The vending machine of claim 1, wherein the product picker is a vacuum picker.

8. The vending machine of claim 1, further comprising:

a camera configured to record image data representative of the contents of the delivery area; and a controller configured to process the recorded image data in order to identify whether or not a product is positioned in the delivery area and to determine an identity of the product;

wherein the controller is configured to compare the recorded image data with one or more sets of image data stored in a memory device to identify a product that is present in the delivery area.

9. The vending machine of claim 8, wherein the controller is configured to store the recorded image data in the memory device associated with a log of product delivery events.

10. The vending machine of claim 8, wherein the controller is configured to automatically transmit the image data to a third party in the event of an error message being returned to the controller.

11. The vending machine of claim 1, wherein the controller is configured to automatically control operation of a user access door to a delivery area of the vending machine in accordance with the identification of whether or not a product is positioned in the delivery area and in accordance with the determined identity of the product.

12. The vending machine of claim 1, further comprising:

a delivery area for the vendible product;

a user access door to the delivery area;

a stepper motor configured to control the operation of the user access door; and a back EMF stall detector associated with the stepper motor configured to detect if the user access door has been obstructed and provide a signal to a controller such that the controller is configured to stop the stepper motor.

13. The vending machine of claim 1, further comprising:

a video camera configured to record image data representative of a customer that is interacting with the vending machine;

a user interface configured to receive a customer selection of a vendible product; and a display screen configured to display a selected vendible product and the image data of the customer such that the selected vendible product is appropriately located relative to the customer.

14. The vending machine of claim 1, further comprising:

individually addressable lights associated with one or more storage locations in the vending machine;

a user interface configured to receive a customer selection of a vendible product; and a controller configured to control the lighting levels of the individually addressable lights in accordance with the user interaction with the user interface.

15. The vending machine of claim 1, further comprising:

a display screen; and one or more video cameras associated with the pick mechanism configured to record, and display in real-time on the display screen, a vendible product as it is being retrieved form a storage location and delivered to a delivery area.

16. A controller for a vending machine, the vending machine comprising:

a pick mechanism configured to retrieve a vendible product in the vending machine, the pick mechanism comprising:

a product picker for releasably attaching to the vendible product; and a motor configured to translate the product picker in a z direction towards the vendible product; and a product picker sensor configured to sense when the product picker encounters a vendible product, wherein the controller is configured to:

receive a sensor signal from the product picker sensor and store in a memory device the location in the z direction of the vendible product as a reference product location; and control the speed of the motor in accordance with the reference product location for a subsequent vendible product retrieval, wherein the speed of the motor is based on a distance between the product picker and the reference product location.

17. The controller of claim 16, wherein the controller is configured to:

set the speed of the motor as a first value when the product picker is more than a threshold distance from a vendible product for the subsequent vendible product retrieval, and set the speed of the motor as a second value, that is different to the first value, when the product picker is less than a threshold distance from a vendible product for the subsequent vendible product retrieval, wherein the first value is greater than the second value.

18. The controller of claim 16, wherein the controller is configured to:

set a product location offset as the thickness of the vendible product; and determine the location in the z direction of the next vendible product by adding or subtracting the product location offset to or from the reference product location and to determine a product location offset by multiplying the thickness of the vendible product by the number of product retrievals since the reference product location was stored.

19. A vending machine comprising:

a pick mechanism configured to retrieve a vendible product in the vending machine, the pick mechanism comprising:

a product picker for releasably attaching to the vendible product; and a motor configured to translate the product picker in a z direction towards the vendible product;

a product picker sensor configured to sense when the product picker encounters a vendible product; and the controller of claim 16.

20. A method of controlling a vending machine, the vending machine comprising:

a pick mechanism configured to retrieve a vendible product in the vending machine, the pick mechanism comprising:

a product picker for releasably attaching to the vendible product; and a motor configured to translate the product picker in a z direction towards the vendible product; and a product picker sensor configured to sense when the product picker encounters a vendible product, wherein the method comprises:

receiving a sensor signal from the product picker sensor and storing in a memory device the location in the z direction of a product as a reference product location; and controlling the speed of the motor in accordance with the reference product location for a subsequent vendible product retrieval, wherein the speed of the motor is based on a distance between the product picker and the reference product location.

* * * * *